US005857260A

United States Patent [19]

Yamada et al.

[11] Patent Number: 5,857,260

[45] Date of Patent: Jan. 12, 1999

[54] CUTTER COMBINATION FOR AN ELECTRIC SHAVER

[75] Inventors: Shuji Yamada, Ashiya; Tadashi Hamada, Sakai; Shigetoshi Sakon; Shinji Fujimoto, both of Shijonawate, all of Japan

[73] Assignee: Matsushita Electric Works, Ltd., Osaka, Japan

[21] Appl. No.: 650,522

[22] Filed: May 20, 1996

[30] Foreign Application Priority Data

May 19, 1995 [JP] Japan ..... 7-121811

[51] Int. Cl.[6] ..... B26B 19/04

[52] U.S. Cl. ..... 30/346.51; 30/346.53; 76/104.1

[58] Field of Search ..... 30/43, 346.51, 30/346.53, 346.54, 43.6, 43.9, 43.92; 148/325, 326, 327; 420/34, 62, 70; 76/104.1

[56] References Cited

U.S. PATENT DOCUMENTS

| | | | |
|---|---|---|---|
| 2,900,719 | 8/1959 | Kohner et al. | 30/346.54 X |
| 3,650,849 | 3/1972 | Nidetzky | 30/346.51 X |
| 4,729,169 | 3/1988 | Asawa | 30/346.51 |
| 5,275,672 | 1/1994 | Althaus et al. | 30/346.54 X |

FOREIGN PATENT DOCUMENTS

| | | | |
|---|---|---|---|
| 4250995 | 9/1992 | Japan . | |
| 5283149 | 10/1993 | Japan . | |
| 6-71062 | 3/1994 | Japan | 30/346.53 |
| 1278085 | 6/1972 | United Kingdom . | |

*Primary Examiner*—Clark F. Dexter
*Attorney, Agent, or Firm*—Burns, Doane, Swecker & Mathis, L.L.P.; William A. Knoeller

[57] ABSTRACT

A cutting device for an electric shaver comprising an outer cutter and a plurality inner blades that are made of a ferrous alloy comprising a substrate of an Fe-Cr stainless steel and a hardened layer of improved hardness and wear resistance. The substrate has a Vickers hardness of 400 or more. The hardened layer has a Vickers hardness of at least 700 and a thickness of 2 to 15 μm. In particular, it is preferred that the hardened layer is a diffusion layer comprising at least 90 vol % of intermetallic compounds of Al and Fe relative to a total volume of the diffusion layer, and Al content included within a depth of at least 2 μm of the diffusion layer is 35 to 65% by weight based upon total weight of a region of the diffusion layer ranging up to the thickness of at least 2 μm. When the ferrous alloy is polished to form the outer cutter and inner blades, it is possible to provide sharp cutting edges of the outer cutter and inner blades, while preventing the occurrence of burrs or micro-chippings at the cutting edges.

6 Claims, 8 Drawing Sheets

CUTTER COMBINATION FOR AN ELECTRIC SHAVER

BACKGROUND OF THE INVENTION

1. Field of the Invention

The present invention is directed to a cutting device for use in an electric shaver, and more particularly to a set of an outer cutter and a plurality of inner cutter blades all made of like material having improved surface hardness.

2. Disclosure of the Prior Art

In the past, martensite stainless steels or precipitation-hardening stainless steels have been used for blades of cutting tools such as electric shavers or hair clippers. Those steels exhibit excellent mechanical toughness and shockproof, although, the surface hardness and wear resistance of the steels are not always enough to provide the cutting tools having an extended service life. In addition, when the stainless steels are polished to form blades of the cutting tools, there is a problem that burrs occur at the cutting edges of the blades. As shown in FIG. 9, as a blade angle θ defined between a top face 2 and side face 4 of a blade 1 is smaller, the occurrence of burrs 5 increases. Therefore, the burrs must be removed from the cutting edges after the polishing step. However, since the cutting edges often receive damages during the removing step of the burrs, it is difficult to make the cutting edge sharp.

To improve this problem, it is proposed to use ceramic materials such as aluminum oxide ($Al_2O_3$) or zirconium oxide ($ZrO_2$) of excellent hardness and wear resistance. However, there is another problem that the mechanical toughness of the ceramic materials is much lower than that of the steels. In addition, it is not easy to machine the ceramic materials to various shapes of the cutting tools.

SUMMARY OF THE INVENTION

The present invention is directed to a cutting device for an electric shaver comprising an outer cutter and a plurality inner blades all made of a ferrous alloy capable of improving and eliminating the above problems. That is, the outer cutter and inner blades are made of a thin plate of the ferrous alloy comprising a substrate of an Fe-Cr stainless steel and a hardened layer formed on a side face of the substrate. The outer cutter is formed with a plurality of openings for receiving therethrough hairs. The outer cutter is formed around each of the openings with a first polished contact surface, a first cutting edge, and a side surface adjacent to the first polished contact surface. An angle of the first cutting edge is defined between the first polished contact surface and the side surface to have an angle of 35° to 90°. On the other hand, each of the inner blades has a second polished contact surface, a second cutting edge, and a side surface adjacent to the second polished contact surface. An angle of the second cutting edge is defined between the second polished contact surface and the side surface to have an angle of 35° to 90°. The inner blades are mounted on a carrier and driven to move in sliding engagement between the first and second polished contact surfaces for cutting the hairs by the second cutting edge in cooperation with the first cutting edge. The hardened layer is formed on the side face of the substrate in such a manner as to appear in an end face of the substrate to define, in cooperation with the end face of the substrate, the first and second polished contact surfaces as well as to define the first and second cutting edges for each of the outer cutter and inner blades. The substrate has a Vickers hardness of at least 400. The hardness layer has a Vickers hardness of at least 700 and a thickness of 2 to 15 μm. In the present invention, when the ferrous alloy is polished to form the outer cutter and inner blades, it is possible to provide sharp cutting edges of the outer cutter and inner blades, while preventing the occurrence of burrs or micro-chippings at the cutting edges. In particular, it is worthy of notice that the occurrence of the burrs can be hardly found at the cutting edges even when the cutting edges are formed to have the small angle of 35°. As a result, electric shavers with the use of the cutting device of the present invention provide good shaving performance, e.g., a shortened shaving time and reduced cutting resistance.

Therefore, it is a primary object of the present invention to provide a cutting device comprising an outer cutter and a plurality inner blades all made of a ferrous alloy comprising a substrate of an Fe-Cr stainless steel and a hardened layer of improved hardness and wear resistance.

It is preferred to use as the substrate an Fe-Cr stainless steel comprising 73 to 89.9 wt % of Fe, 10 to 19 wt % of Cr, 0.1 to 1.2 wt % of C, and less than 3 wt % of Ni, or a Fe-Cr stainless steel comprising 69 to 81.5 wt % of Fe, 12 to 18 wt % of Cr., 6 to 8.5 wt % of Ni, 0.5 to 2 wt % of at least one element selected from Al and Ti.

In a further preferred embodiment of the present invention, the hardened layer is an Fe-Al diffusion layer comprising at least 90 vol % of intermetallic compounds of Al and Fe relative to a total volume of the diffusion layer, and also Al content included within a depth of at least 2 μm of the Fe-Al diffusion layer is 35 to 65% by weight based upon total weight of a region of the Fe-Al diffusion layer ranging up to the thickness of at least 2 μm. In this case, since the diffusion layer is formed through the mutual diffusion between metal elements of the substrate, e.g., Fe and Cr, and Al of an Al layer coated on the substrate, it is possible to provide excellent adhesion between the diffusion layer and the substrate.

Other features, advantages and effects of the present invention will become apparent by the detailed explanation below with the attached drawings.

BRIEF DESCRIPTION OF THE DRAWINGS

In FIGS. 7A and 7B.

In FIGS. 8A and 8B.

DETAILED DESCRIPTION OF THE INVENTION

Figure 1:
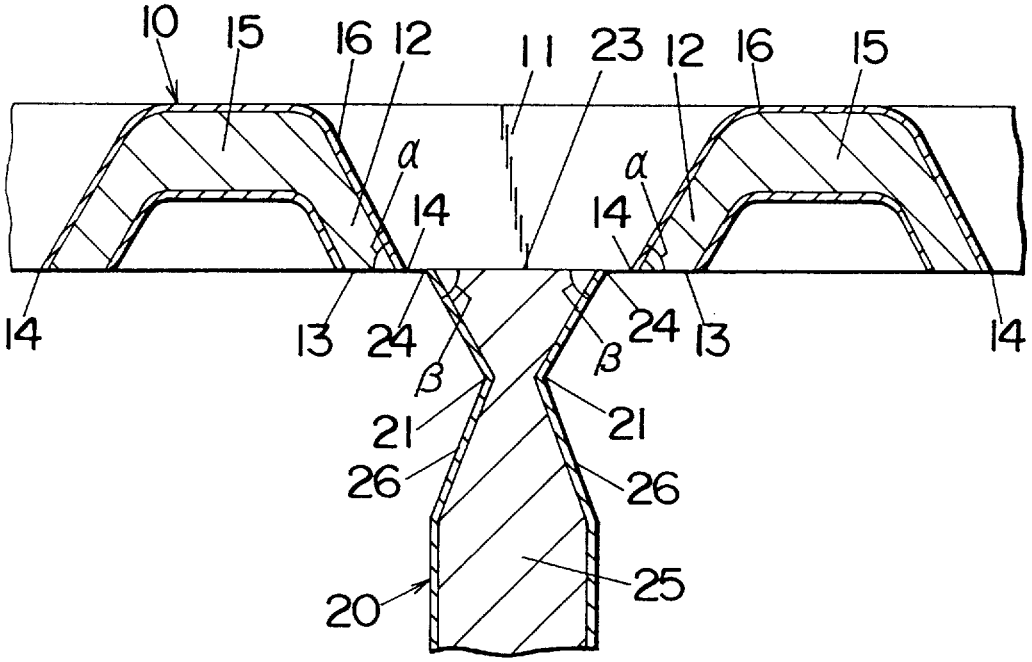
FIG. 1 is a cross-sectional view showing the hair-cutting engagement between an outer cutter and inner blade of a cutting device made of a ferrous alloy of the present invention.
Figure 2:
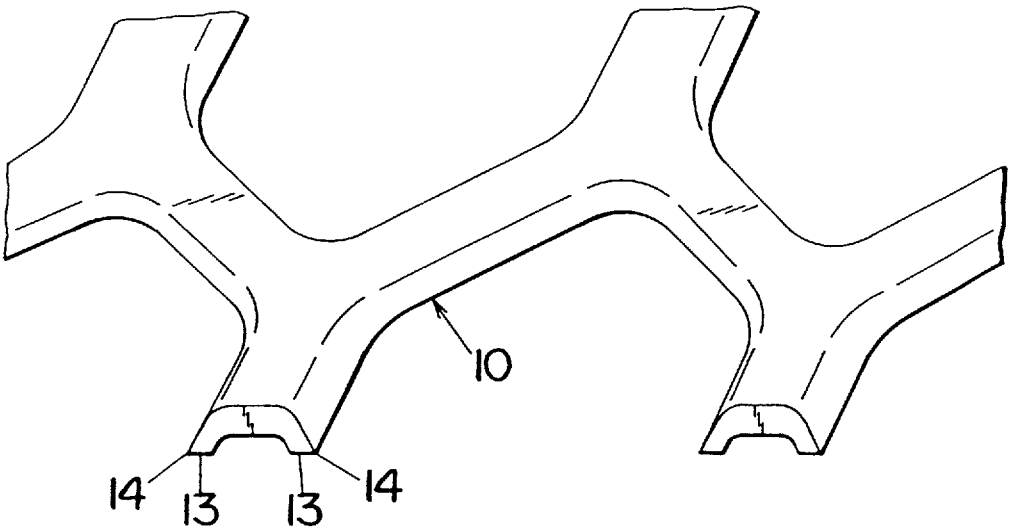
FIG. 2 is a perspective view of a part of the outer cutter.
Figure 3:
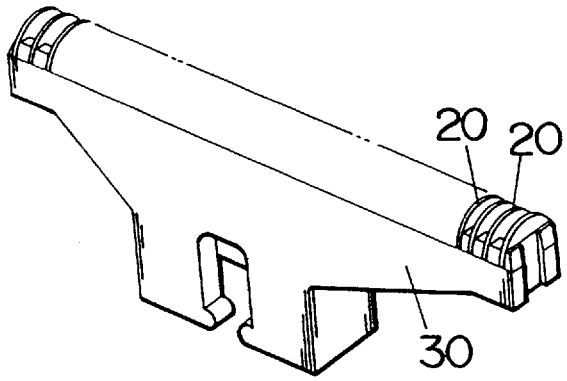
FIG. 3 is a perspective view of the inner blades mounted on a carrier.

Referring now to FIGS. 1 to 3, a cutting device for an electric shaver in accordance with the present invention comprises an outer cutter 10 held on a cutter head (not shown) of the electric shaver and a plurality of inner blades 20 mounted on a carrier 30 which is driven to move within the cutter head in hair cutting engagement with the outer cutter. The outer cutter 10 of the illustrated embodiment is in the form of a foil with a number of openings or perforations 11 which are made by punching the foil to be surrounded by a downward bent rim 12. The lower end face of the rim 12 is polished to have a first polished contact surface 13 with a first cutting edge 14. The inner blades 20 are each formed at its upper end face with a second polished contact surface 23 with second cutting edges 24 on opposite sides of the blade. The inner blades 20 are mounted on the carrier 30 in a parallel relation to each other and are driven to move in such a manner that the second polished contact surfaces 23 come into sliding engagement with the first contact surface 13 of the outer cutter 10, whereby hairs entering through the perforations 11 are cut by the second edges 24 in cooperation with the first cutting edges 14.

Figure 4:
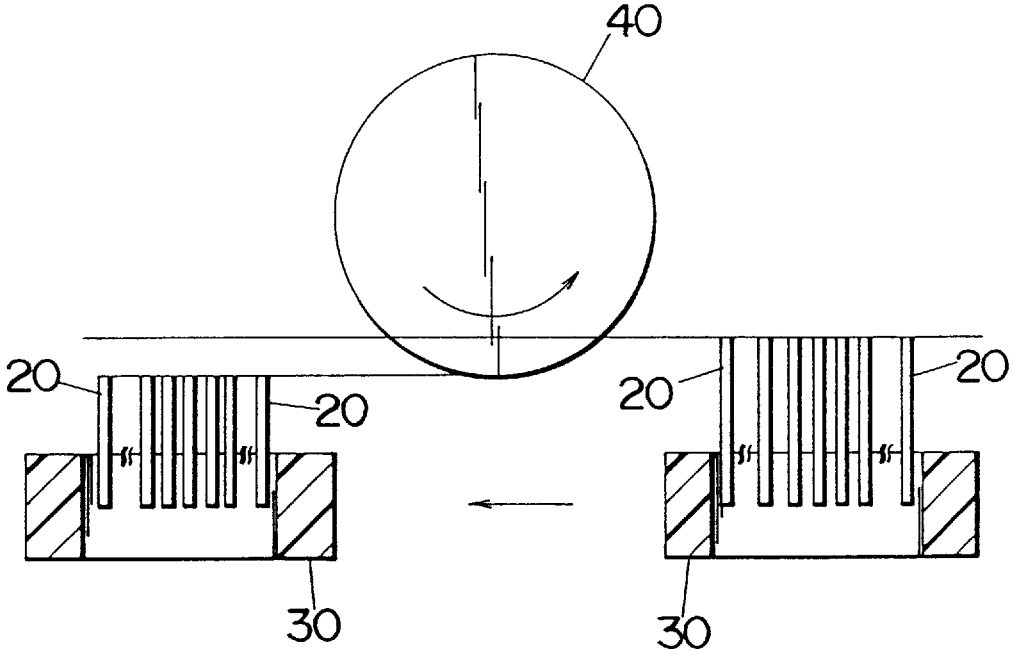
FIG. 4 shows a method of polishing the inner blades on the carrier.

The lower end of the rim 12 is polished to have the first contact surface 13 with the first cutting edge of an acute angle $\alpha$ of 35° to 90° around the perforation 11 and leave an edge of an obtuse angle. The inner blade 20 is formed on opposite side faces immediately below the upper end face thereof with undercuts 21 which are responsible for providing the second cutting edges 24 at an acute angle $\beta$ of 35° to 90° on opposite sides of the second contact surface 23. All the inner blades 20 are simultaneously polished in order to conform the polished second contact surface 23 intimately to a contour of the outer cutter 10. As shown in FIG. 4, the polishing is made by feeding the carrier 30 to a fixed grinder 40 so as to polish the upper ends of the inner blades 20 mounted on the carrier.

Each of the outer cutter 10 and the inner blades 20 is made from a ferrous alloy which comprises a substrate of an Fe-Cr stainless steel 15, 25 and a hardened layer 16, 26 formed on opposite sides of the substrate 15, 25. For example, it is preferred to use as the substrate a Fe-Cr stainless steel comprising 73 to 89.9 wt % of Fe, 10 to 19 wt % of Cr, 0.1 to 1.2 wt % of C, and less than 3 wt % of Ni, or a Fe-Cr stainless steel comprising 69 to 81.5 wt % of Fe, 12 to 18 wt % of Cr, 6 to 8.5 wt % of Ni, 0.5 to 2 wt % of at least one element selected from Al and Ti. The hardened layer is formed to have a thickness of 2 to 15 $\mu$m and a hardness of 700 or more in order to prevent the cutting edge from drooping, blunting, or dulling during the operation of polishing the first and second contact surfaces of the outer cutter and the inner blade as well as during the extended use of the electric shaver, thereby maintaining improved cutting efficiency over a prolonged use. The substrate is selected to have a Vickers hardness of at least 400 in order to give sufficient wear resistance as well as rigidness required for the use of the electric shaver. The cutting device of the present invention can be used in any type of the electric shaver including, for example, a reciprocatory type in which the inner blades are driven to reciprocate and a rotary type in which the inner blades are driven to rotate about an axis.

It is preferred that the hardened layer is an Fe-Al diffusion layer comprising at least 90 vol % of intermetallic compounds of Al and Fe relative to a total volume of the diffusion layer. The Al content included within a depth of at least 2 $\mu$m of the Fe-Al diffusion layer is 35 to 65% by weight based upon total weight of a region of the Fe-Al diffusion layer ranging up to the thickness of at least 2 $\mu$m. When the volume ratio of the Al-Fe-intermetallic compounds is less than 90 vol %, the hardness of the diffusion layer is lowered because of a pure Al and an Al alloy of poor hardness remained in the diffusion layer. On the other hand, when the Al content is less than 35 wt %, it is not enough to give improved hardness and wear resistance to the diffusion layer. When the Al content is more than 65 wt %, a pure Al pool and/or Fe-Al solid solution of a poor hardness are formed in the diffusion layer.

Figure 5:
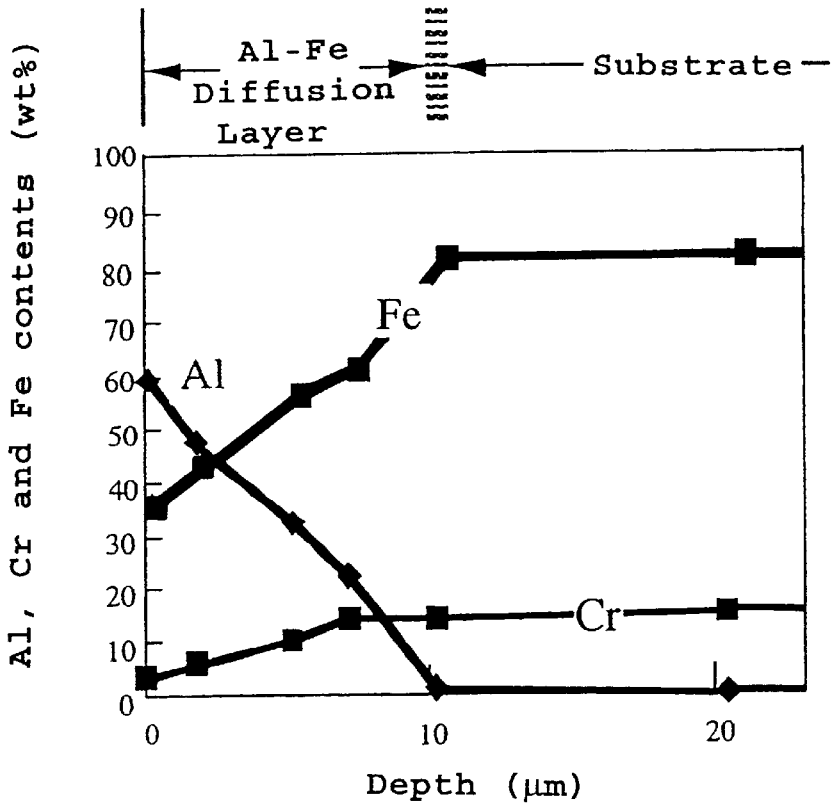
FIG. 5 is curves showing the variations of Al, Cr and Fe contents in the depth from the outer surface of a diffusion layer of the ferrous alloy.

FIG. 5 shows the variations of the Al, Cr and Fe contents in the depth from the outer surface of the diffusion layer, which were quantitatively analyzed by means of an X-ray micro analysis. The curve of the Al content shows that the Al content included within a depth of about 2 $\mu$m from the outer surface of the diffusion layer is in the range of 45 to 60% by weight based upon total weight of a region of the diffusion layer ranging up to the thickness of about 2 $\mu$m. Since the Al content of 60 wt % corresponds to about 76 atom %, it could be presumed that $Al_3Fe$ is formed in the outer surface of the diffusion layer.

Figure 6:
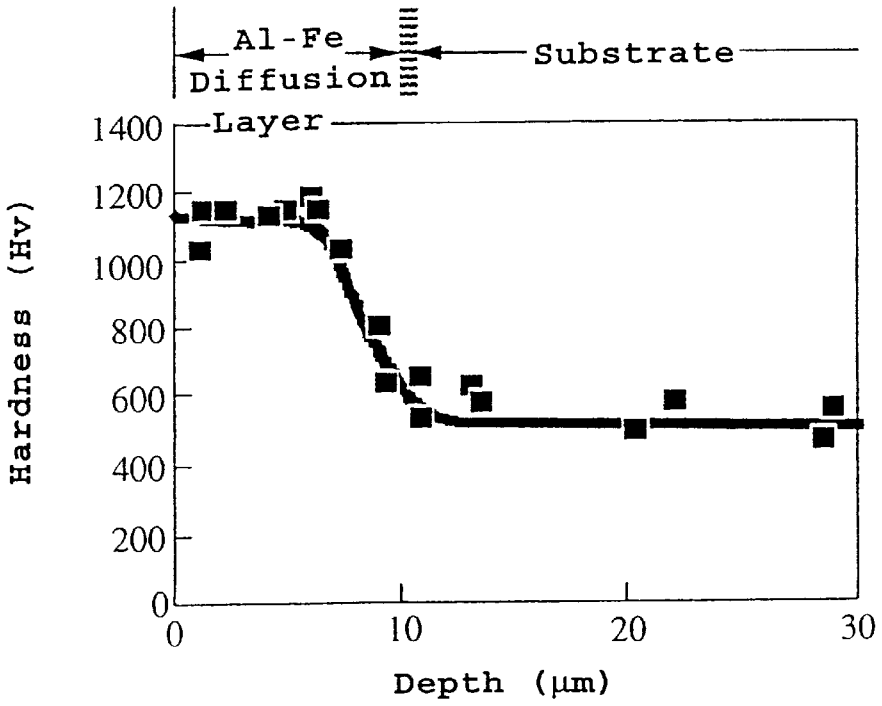
FIG. 6 is a curve showing the variation of Vickers hardness in the depth from the outer surface of the diffusion layer.

The variation of Vickers hardness in the depth from the outer surface of the diffusion layer is shown in FIG. 6. The hardness was measured under the load of 2 gf. From the curve of FIG. 6, it is readily understood that the high hardness (Hv) of about 1140 is stably obtained over a range of the diffusion layer from the outer surface to the depth of about 6 $\mu$m. This range of the diffusion layer substantially corresponds to the range of the Al content of 35 to 60 wt %, as shown in FIG. 5. The hardness gradually decreases from the range toward the depth of about 10 $\mu$m, and finally reaches about 500 (Hv) of the substrate hardness.

The diffusion layer can be identified by an X-ray diffraction analysis. An X-ray profile of the diffusion layer may be taken by using an X-ray diffraction apparatus with conventional Cu-k$\alpha$ X-ray source and 2$\theta$-$\theta$ goniometer at accelerating voltage and current of 40 kV and 200 mA. The X ray is irradiated to the outer surface of the diffusion layer. It is confirmed by the X-ray diffraction analysis that the diffusion layer contains a plurality of intermetallic compounds of Fe and Al.

In the present invention, the diffusion layer contains at least 90 vol % of the intermetallic compounds of Al and Fe relative to a total volume of the diffusion layer. The volume ratio (V: vol %) can be determined by the following equation:

$$V\ (\text{vol }\%)=100\times \mathbf{S1}/(\mathbf{S1}+\mathbf{S2})$$

where S1 is a total of the peak-areas of all Al-Fe intermetallic compounds identified on an X-ray diffraction profile, and S2 is a total of the peak-areas of pure Al, and/or an Al alloy in which Fe mainly forms a solid solution with Al, except for the Al-Fe intermetallic compounds on the X-ray profile.

By the way, when the Al content at the outer surface of the diffusion layer is more than 65 wt %, some peaks of pure Al are often identified. In addition, any peak of $Al_2O_3$ is not identified in the X-ray profile of the diffusion layer of the present invention. Moreover, the diffusion layer contains a small amount of Cr, as shown in FIG. 5. Even if a small amount of Al-Cr intermetallic compound is formed in the diffusion layer, there is no problem because the hardness of the diffusion layer is not lowered.

When the substrate is an Fe-Cr-Ni stainless steel, it is preferred that the hardened layer contains particles of a nitride of at least one element selected from the group consisting of Cr, Al, and Ti, which are dispersed in the surface of the substrate. When the substrate is an Fe-Cr-C stainless steel, it is preferred that the hardened layer contains particles of chromium nitride which are dispersed in the surface of the substrate. In these two case, the hardened layer may formed by an ion-nitriding method.

The following examples further illustrates the nature and advantages of the present invention.

EXAMPLE 1

(Outer cutter)

A 0.025 mm thick ferrous sheet of Fe-Cr-C stainless steel [Fe-14Cr-1.1Mo-0.7C] was used as a substrate for the outer cutter. The ferrous sheet was coated on its opposite surfaces by molten metal plating with 0.005 mm thick aluminum layers to obtain a 0.035 mm thick plated sheet. Thus plated sheet was processed in a conventional fashion to have patterns of the perforations 11 each surrounded by downward bent rims 12 and was then heated at 975° C. for 15 seconds followed by being air-cooled to give 5 $\mu$m thick Fe-Al hardened layers on opposite surfaces of the substrate as well as to make quenching the substrate. The resulting Fe-Al hardened layer 16 shows an increased Vickers hardness of 1100 Hv, while the substrate 15 shows an increased Vickers hardness of 500 Hv. Thus treated sheet was then processed to polish the lower ends of the rims around the perforations 11 by the use of a wheel containing BN (boron nitride) of 1200 mesh and having the diameter of 150 mm. The wheel was rotated at the speed of 500 rpm. The sheet was fed at the speed of 10 cm/sec to the rotated wheel to give a polished contact surface 13 at the lower end of each rim as well as give a cutting edge 14 at an angle $\alpha$ of 60° around the periphery of each perforation 11. After being polished, the sheet was formed with the sharp cutting edge having burrs of a size at most 1 $\mu$m. The outer cutter 10 was then cut out from the sheet, shaped into an intended configuration, and mounted to a suitable holder.

(Inner blades)

Figure 7A:
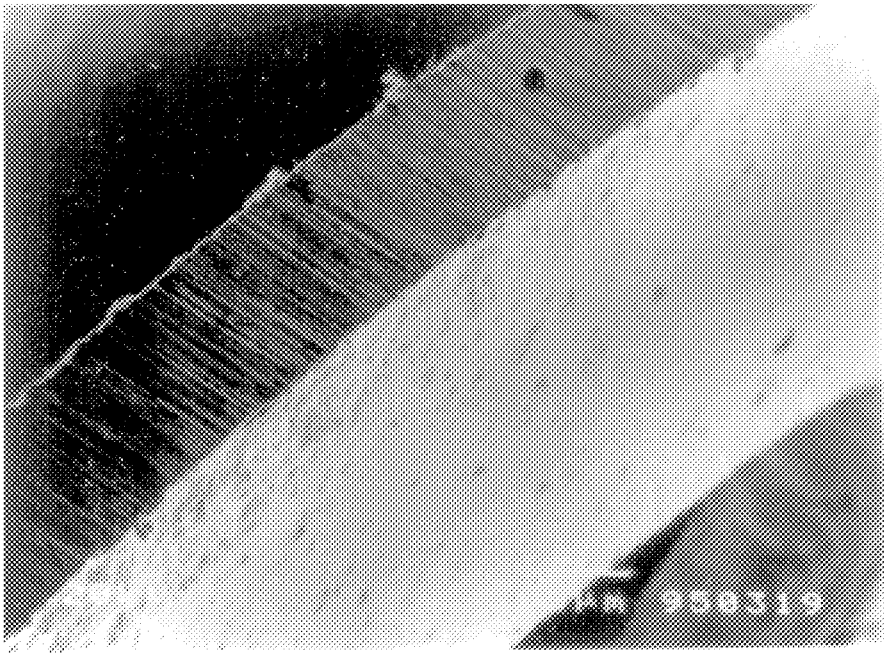
FIG. 7A is a SEM photograph of the inner blade of Example 1.
Figure 7B:
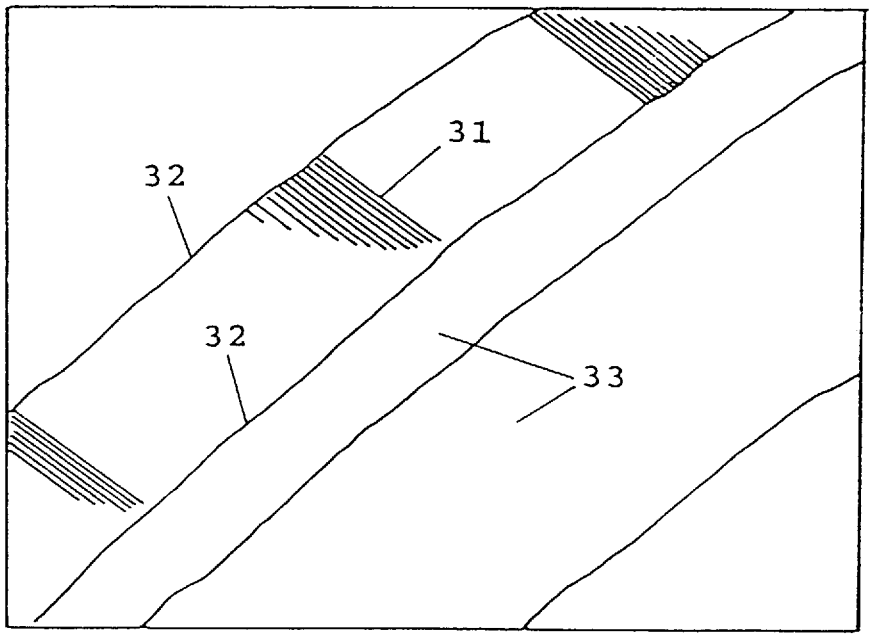
FIG. 7B is an explanation sketch of FIG. 7A.

A 0.25 mm thick ferrous sheet of Fe-Cr-C stainless steel [Fe-14-Cr1.1Mo-0.7C] was used as a substrate for the inner blades. The ferrous sheet was provided on its opposite surfaces with 0.015 mm thick aluminum foils followed by being rolled to obtain a 0.2 mm thick clad sheet in which the Al foils were cohered to the substrate. After the inner blades 20 were cut from the clad sheet, each inner blade was shaped into an intended configuration having the undercuts 21 in its opposite surfaces. The inner blades were then heated at 1000° C. for 30 seconds followed by being air-cooled to give 10 $\mu$m thick Fe-Al hardened layers on the opposite surfaces of the substrate as well as to make quenching the substrate. The resulting Fe-Al hardened layer 26 shows an increased Vickers hardness of 1100 Hv, while the substrate 25 shows an increased Vickers hardness of 500 Hv. A plurality of thus obtained inner blades were partly molded into the carrier 30 to be thereby anchored thereto. Then, the carrier 30 was held on a feed table with the inner blades standing upright and was fed at the speed of 10 cm/sec relative to the wheel 40 rotating at the speed of 500 rpm in order to polish the upper ends of the inner blades, as shown in FIG. 4. The wheel 40 contains BN (boron nitride) of 500 mesh. Through this polishing, the inner blades are finished to have the polished contact surface with the cutting edges at an angle $\beta$ of 60°. FIGS. 7A and 7B illustrate the outer profile of thus finished inner blade. In FIG. 7B, the numerals 31 and 32 designate the polished contact surface and the cutting edges of the inner blade, respectively. The numeral 33 designates the hardened layer. As seen in these figures, the inner blade is found to have the sharp cutting edges free from any substantial burrs.

In accordance with an X-ray diffraction profile obtained through an X-ray diffraction at the outer surface of the hardened layer of each of the outer cutter and inner blade, a volume ratio (V: vol %) of Al-Fe intermetallic compounds in the hardened layer was determined by the following equation:

$$V\ (\text{vol }\%)=100\times \mathbf{S1}/(\mathbf{S1}+\mathbf{S2})$$

where S1 is a total of the peak-areas of all Al-Fe intermetallic compounds identified on the X-ray profile, and S2 is a total of the peak-areas of pure Al, and/or an Al alloy in which Fe mainly forms a solid solution with Al, except for the Al-Fe intermetallic compounds on the X-ray profile. Results are listed on Table 1.

Moreover, the Al content included within the depth of about 2 $\mu$m from the outer surface of the hardened layer was determined by means of X-ray micro analysis. The Al content is expressed by weight based upon total weight of a region of the hardened layer ranging up to the thickness of about 2 $\mu$m. Results are listed on Table 1.

The same analysises, test, and measurements as Example 1 were performed in Examples and Comparative Examples described below.

EXAMPLE 2

The outer cutter was prepared from the same material and in the identical manner as in Example 1 except that it was configured to make a cutting edge having an angle $\alpha$ of 35°. The resulting cutting edge is found to have burrs of a 1 $\mu$m size at most.

The inner blades were prepared from the same material and in the identical manner as in Example 1.

EXAMPLE 3

The outer cutter was prepared from the same material and in the identical manner as in Example 1 except that it was configured to make a cutting edge having an angle $\alpha$ of 90° free from any substantial burrs.

The inner blades were prepared from the same material and in the identical manner as in Example 1.

EXAMPLE 4

The outer cutter was prepared from the same material and in the identical manner as in Example 1.

The inner blades were prepared from the same material and in the identical manner as in Example 1 except that each inner blade was configured to make a cutting edge having an angle $\beta$ of 50° free from any substantial burrs.

EXAMPLE 5

The outer cutter was prepared from the same material and in the identical manner as in Example 1.

The inner blades were prepared from the same material and in the identical manner as in Example 1 except that each inner blade was configured to have no undercut. Each of the resulting inner blades has a cutting edge having an angle $\beta$ of 90° free from any substantial burrs.

EXAMPLE 6

The outer cutter was prepared from the same material and in the identical manner as in Example 1.

For preparing the inner blades, a 0.20 mm thick ferrous sheet of Fe-Cr-C stainless steel [Fe-14Cr-1.1Mo-0.7C] was used as a substrate. The ferrous sheet was provided on its opposite surfaces with 0.020 mm thick aluminum foils followed by being rolled to obtain a 0.2 mm thick clad sheet in which the Al foils were cohered to the substrate. After the inner blades 20 were cut from the clad sheet, each inner blade was shaped into an intended configuration having the undercuts 21 in its opposite surfaces. The inner blades were then heated at 1000° C. for 30 seconds followed by being air-cooled to give 15 μm thick Fe-Al hardened layers on the opposite surfaces of the substrate as well as to make quenching the substrate. The resulting Fe-Al hardened layer 26 shows an increased Vickers hardness of 1100 Hv, while the substrate 25 shows an increased Vickers hardness of 500 Hv. Thus obtained inner blades were polished in the same manner as in Example 1 to have the polished contact surface with the cutting edges at an angle β of 60° free from any substantial burrs.

EXAMPLE 7

The outer cutter was prepared from the same material and in the identical manner as in Example 1.

For preparing the inner blades, a 0.196 mm thick ferrous sheet of Fe-Cr-C stainless steel [Fe-14Cr-1.1Mo-0.7C] was used as a substrate. The ferrous sheet was coated on its opposite surfaces by vacuum deposition with 0.002 mm thick aluminum layers to obtain a 0.2 mm thick Al-deposited sheet. After the inner blades 20 were cut from the Al-deposited sheet, each inner blade was shaped into an intended configuration having the undercuts 21 in its opposite surfaces. The inner blades were then heated at 950° C. for 30 seconds followed by being air-cooled to give 2 μm thick Fe-Al hardened layers on the opposite surfaces of the substrate as well as to make quenching the substrate. The resulting Fe-Al hardened layer 26 shows an increased Vickers hardness of 1100 Hv, while the substrate 25 shows an increased Vickers hardness of 500 Hv. Thus obtained inner blades were polished in the same manner as in Example 1 to have the polished contact surface with the cutting edges at an angle β of 60° free from any substantial burrs.

EXAMPLE 8

The outer cutter was prepared from the same material and in the identical manner as in Example 1.

The inner blades were cut from the 0.2 mm thick Al-clad sheet obtained in Example 1. Each of the inner blades was shaped to have the undercuts 21 in its opposite surfaces. The inner blades were then heated at 900° C. for 60 seconds followed by being air-cooled to give 10 μm thick Fe-Al hardened layers on opposite surfaces of the substrate as well as to make quenching the substrate. The resulting Fe-Al hardened layer 26 shows an increased Vickers hardness of 1100 Hv, while the substrate 25 shows an increased Vickers hardness of 400 Hv. Thus obtained inner blades were polished in the same manner as in Example 1 to have the polished contact surface with the cutting edges at an angle β of 60° free from any substantial burrs.

EXAMPLE 9

The outer cutter was prepared from the same material and in the identical manner as in Example 1.

The inner blades were cut from the 0.2 mm thick Al-clad sheet obtained in Example 1. Each of the inner blades was shaped to have the undercuts 21 in its opposite surfaces. The inner blades were then heated at 1000° C. for 60 seconds followed by being air-cooled to give 10 μm thick Fe-Al hardened layers on opposite surfaces of the substrate as well as to make quenching the substrate. The resulting Fe-Al hardened layer 26 shows an increased Vickers hardness of 700 Hv, while the substrate 25 shows an increased Vickers hardness of 500 Hv. Thus obtained inner blades were polished in the same manner as in Example 1 to have the polished contact surface with the cutting edges at an angle β of 60° having burrs of a size as less as 2 μm.

EXAMPLE 10

The outer cutter was prepared from the same material and in the identical manner as in Example 1.

The inner blades were cut from a 0.2 mm thick ferrous sheet of Fe-Cr-C stainless steel [Fe-18Cr-1.5Mo-0.7C]. Each of the inner blades was shaped to have the undercuts 21 in its opposite surfaces. The inner blades were then heated in an inert atmosphere at 1050° C. for 90 seconds followed by being air-cooled to make quenching the substrate.

Thereafter, the inner blades were placed in an ion-nitriding furnace in which a gas discharging was made at 450° C. for 3 hours to provide a 3 μm thick hardened layer. It is observed that particles of chromium nitride are dispersed in the resulting hardened layer. The hardened layer 26 shows an increased Vickers hardness of 800 Hv, while the substrate 25 retains a Vickers hardness of 400 Hv as a result of that the effect of the quenching remains to some extent. Thus obtained inner blades were polished in the same manner as in Example 1 to have the polished contact surface with the cutting edges at an angle β of 60° having burrs of a size as less as 2 μm.

EXAMPLE 11

The outer cutter was prepared from the same material and in the identical manner as in Example 1.

The inner blades were cut from a 0.2 mm thick ferrous sheet of Fe-Cr-Ni stainless steel [Fe-17Cr-7Ni-1.2Al]. Each of the inner blades was shaped to have the undercuts 21 in its opposite surfaces. The inner blades were placed in an ion nitriding furnace in which a gas discharging was made at 570° C. for 3 hours to provide a 6 μm thick hardened layer. It is observed that particles of chromium nitride and aluminum nitride are dispersed in the resulting hardened layer. The hardened layer 26 shows an increased Vickers hardness of 900 Hv, while the substrate 25 shows a Vickers hardness of 500 Hv. Thus obtained inner blades were polished in the same manner as in Example 1 to have the polished contact surface with the cutting edges at an angle β of 60° having burrs of a size as less as 1 μm.

EXAMPLE 12

The outer cutter was prepared from the same material and in the identical manner as in Example 1.

The inner blades were cut from a 0.2 mm thick ferrous sheet of Fe-Cr-Ni stainless steel [Fe-13Cr-6.5Ni-0.7Al-0.5Ti]. Each of the inner blades was shaped to have the undercuts 21 in its opposite surfaces. The inner blades were placed in an ion-nitriding furnace in which a gas discharging was made at 520° C. for 3 hours to provide a 5 μm thick hardened layer. It is observed that particles of nitrides of Cr, Al and Ti, are dispersed in the resulting hardened layer. The hardened layer 26 shows an increased Vickers hardness of 1000 Hv, while the substrate 25 shows a Vickers hardness of 500 Hv. Thus obtained inner blades were polished in the same manner as in Example 1 to have the polished contact surface with the cutting edges at an angle β of 60° having burrs of a size as less as 1 μm.

Comparative Example 1

(Outer cutter)

A 0.036 thick ferrous sheet of Fe-Cr-C stainless steel [Fe-14Cr1.1Mo-0.7C] was used for the outer cutter. The ferrous sheet was processed to have patterns of the perforations 11 each surrounded by downward bent rim 12 and was then heated at 1050° C. for 60 seconds followed by being air-cooled to make quenching the substrate. The resulting sheet shows a Vickers hardness of 650 Hv. Thus treated sheet was then processed in the same manner as in Example 1 to give a polished contact surface 13 at the lower end of each rim as well as give a cutting edge 14 at an angle α of 60° around the periphery of each perforation. The resulting cutting edge suffers from burrs of a size as much as 50 μm. After being removed of the burrs, the outer cutter 10 was then cut out from the sheet, shaped into an intended configuration, and mounted to a suitable holder in the same manner as in Example 1.

(Inner blades)

Figure 8A:
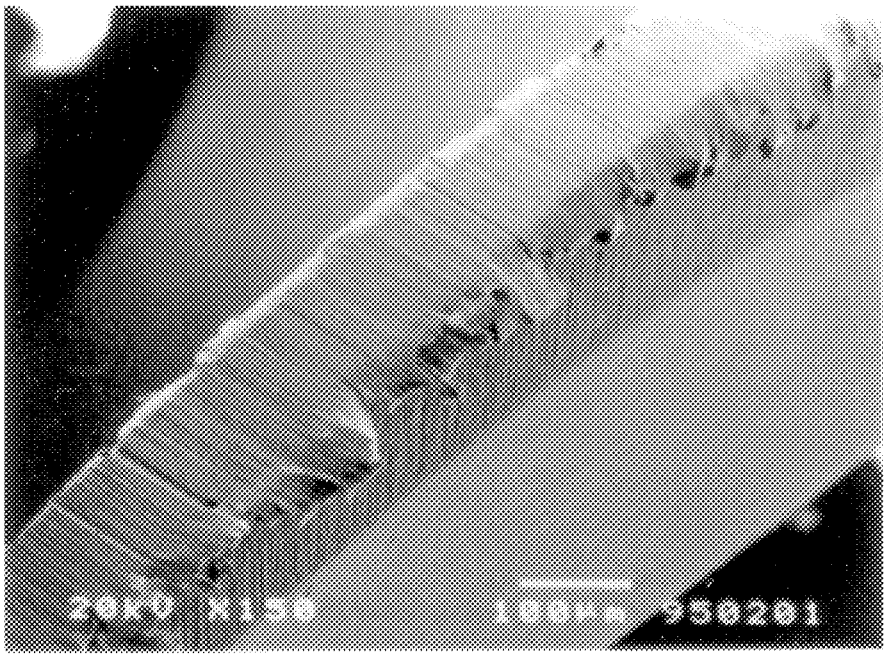
FIG. 8A is a SEM photograph of the inner blade of Comparative Example 1.
Figure 8B:
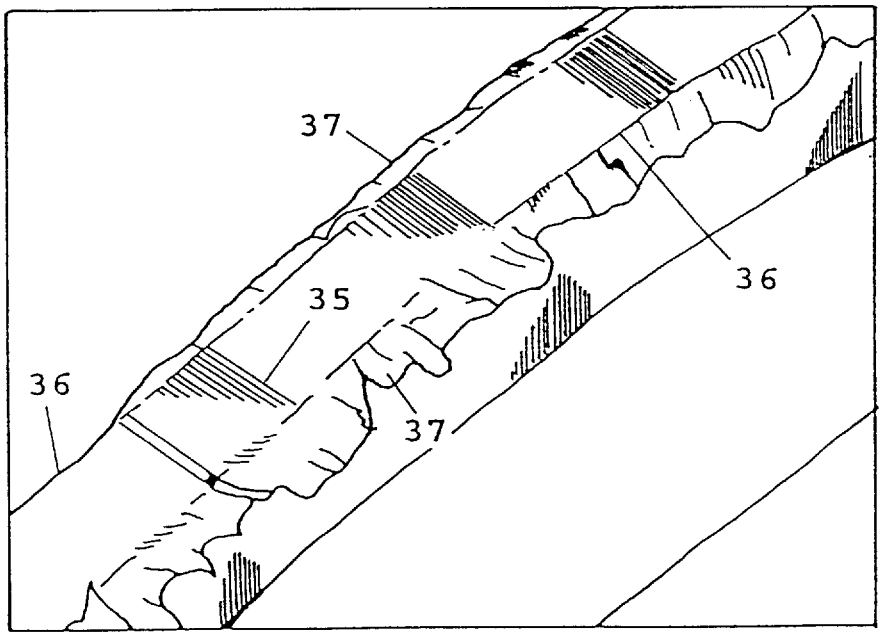
FIG. 8B is an explanation sketch of FIG. 8A.
Figure 9:
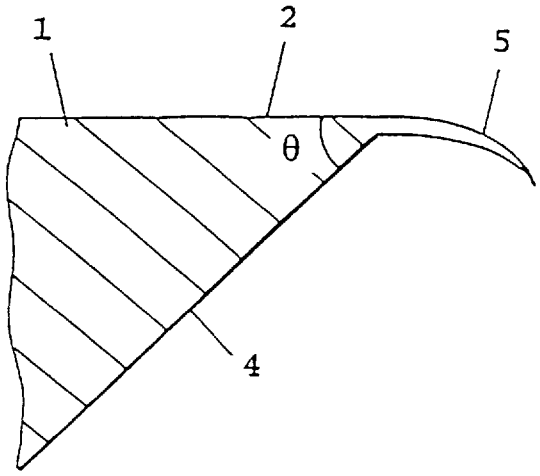
FIG. 9 (PRIOR ART)
FIG. 9 is an explanation sketch showing the occurrence of a burr at a cutting edge.

A 0.2 mm thick ferrous sheet of Fe-Cr-C stainless steel [Fe-14Cr1.1Mo-0.7C] was used for the inner blades. After the inner blades 20 were cut from the sheet, each inner blade was shaped to have the undercuts 21 in its opposite surfaces. The inner blades were then heated at 1050° C. for 60 seconds followed by being air-cooled to make quenching the substrate. The resulting inner blade 26 shows an increased Vickers hardness of 600 Hv. A plurality of thus obtained inner blades were mounted on the carrier 30 and polished in the same manner as in Example 1 so that each inner blade has a polished contact surface with the cutting edges at an angle β of 60°. The resulting cutting edge suffers from burrs of a size as much as 50 μm, as shown in FIGS. 8A and 8B which are SEM photograph and an explanation sketch of FIG. 8A showing the profile of the cutting edge. In FIG. 8B, the numerals 35 and 36 designate the polished contact surface and the cutting edges, respectively. The numeral 37 designates the burrs formed at the cutting edges 36.

Comparative Example 2

The outer cutter was prepared from the same material and in the identical manner as in Example 1.

For preparing the inner blades, a 0.35 mm thick ferrous sheet of Fe-Cr-C stainless steel [Fe-14Cr-1.1Mo-0.7C] was used as a substrate. The ferrous sheet was coated on its opposite surfaces with 0.015 mm thick aluminum foils followed by being rolled to obtain a 0.3 mm thick clad sheet in which the Al foils were cohered to the substrate. After the inner blades 20 were cut from the clad sheet, each inner blade was shaped to have the undercuts 21 in the opposite surfaces. The inner blades were then heated at 1000° C. for 30 seconds followed by being air-cooled to give 10 μm thick Fe-Al hardened layers on opposite surfaces of the substrate as well as to make quenching the substrate. The resulting Fe-Al hardened layer 26 shows an increased Vickers hardness of 1100 Hv, while the substrate 25 shows an increased Vickers hardness of 500 Hv. Thus obtained inner blades were polished in the same manner as in Example 1 to have the polished contact surface with the cutting edges at an angle β of 30° free from any substantial burrs.

Comparative Example 3

The outer cutter was prepared from the same material and in the identical manner as in Example 1.

The inner blades were prepared from the same material and in the identical manner as Example 1 except that each inner blade was configured to make a cutting edge having an angle β of 100° free from any substantial burrs.

Comparative Example 4

The outer cutter was prepared from the same material and in the identical manner as in Example 1 except that it was configured to make a cutting edge having an angle α of 30°. The resulting cutting edge is found to suffer from burrs of a size 1 μm at most.

The inner blades were prepared from the same material and in the identical manner as in Example 1.

Comparative Example 5

The outer cutter was prepared from the same material and in the identical manner as in Example 1 except that it was configured to make a cutting edge having an angle α of 100°. The resulting cutting edge is found to be free from any substantial burrs.

The inner blades were prepared from the same material and in the identical manner as in Example 1.

Comparative Example 6

The outer cutter was prepared from the same material and in the identical manner as in Example 1.

For preparing the inner blades, a 0.197 mm thick ferrous sheet of Fe-Cr-C stainless steel [Fe-14Cr-1.1Mo-0.7C] was used as a substrate. The ferrous sheet was coated on its opposite surfaces by vacuum deposition with 0.0015 mm thick aluminum layers to obtain a 0.2 mm thick Al-deposited sheet. After the inner blades 20 were cut from the Al-deposited sheet, each inner blade was shaped into an intended configuration having the undercuts 21 in its opposite surfaces. The inner blades were then heated at 950° C. for 30 seconds followed by being air-cooled to give 1.5 μm thick Fe-Al hardened layers on opposite surfaces of the substrate as well as to make quenching the substrate. The resulting Fe-Al hardened layer 26 shows an increased Vickers hardness of 1100 Hv, while the substrate 25 shows an increased Vickers hardness of 500 Hv. Thus obtained inner blades were polished in the same manner as in Example 1 to have the polished contact surface with the cutting edges at an angle β of 60° and suffering from burrs of a size as much as 20 μm.

Comparative Example 7

The outer cutter was prepared from the same material and in the identical manner as in Example 1.

For preparing the inner blades, a 0.20 mm thick ferrous sheet of Fe-Cr-C stainless steel [Fe-14Cr-1.1Mo-0.7C] was used as a substrate. The ferrous sheet was coated on its opposite surfaces with 0.022 mm thick aluminum foils followed by being rolled to obtain a 0.2 mm thick clad sheet in which the Al foils were cohered to the substrate. After the inner blades 20 were cut from the clad sheet, each inner blade was shaped to have the undercuts 21 in the opposite surfaces. The inner blades were then heated at 1000° C. for 30 seconds followed by being air-cooled to give 17 μm thick Fe-Al hardened layers on opposite surfaces of the substrate as well as to make quenching the substrate. The resulting Fe-Al hardened layer 26 shows an increased Vickers hardness of 1100 Hv, while the substrate 25 shows an increased Vickers hardness of 500 Hv. Thus obtained inner blades were polished in the same manner as in Example 1 to have the polished contact surface with the cutting edges at an angle β of 60° free from any substantial burrs.

Comparative Example 8

The outer cutter was prepared from the same material and in the identical manner as in Example 1.

The inner blades were cut from the 0.2 mm thick Al-clad sheet obtained in Example 1. Each of the inner blades was shaped to have the undercuts 21 in its opposite surfaces. The inner blades were then heated at 850° C. for 60 seconds followed by being air-cooled to give 10 μm thick Fe-Al hardened layers on opposite surfaces of the substrate as well as to make quenching the substrate. The resulting Fe-Al hardened layer 26 shows an increased Vickers hardness of 1100 Hv, while the substrate 25 shows a Vickers hardness of 350 Hv. Thus obtained inner blades were polished in the same manner as in Example 1 to have the polished contact surface with the cutting edges at an angle β of 60° free from any substantial burrs.

Comparative Example 9

The outer cutter was prepared from the same material and in the identical manner as in Example 1.

The inner blades were cut from the 0.2 mm thick Al-clad sheet obtained in Example 1. Each of the inner blades was shaped to have the undercuts 21 in its opposite surfaces. The inner blades were then heated at 1000° C. for 120 seconds followed by being air-cooled to give 10 μm thick Fe-Al hardened layers on opposite surfaces of the substrate as well as to make quenching the substrate. The resulting Fe-Al hardened layer 26 shows an increased Vickers hardness of 650 Hv, while the substrate 25 shows an increased Vickers hardness of 500 Hv. Thus obtained inner blades were polished in the same manner as in Example 1 to have the polished contact surface with the cutting edges at an angle β of 60° having burrs of a size as much as 20 μm.

With respect to Examples 1 to 12 and Comparative Examples 2 to 9, the thickness (μm) and Vickers hardness (Hv) of the hardened layer, Al content (wt %) included within a depth of about 2 μm of the hardened layer, volume ratio (vol %) of intermetallic compounds of Fe and Al relative to a total volume of the hardened layer, and Vickers hardness (Hv) of the substrate, are listed on Table 1. However, each of the inner blades of Examples 10 to 12 does not have any Al-Fe intermetallic compound in the hardened layer, therefore, the Al content, and volume ratio can not be determined. In addition, there is no hardened layer in the outer cutter and inner blades of Comparative Example 1, therefore, only the hardness of the substrate was measured, as listed on Table 1. In Comparative Example 6, the Al content and the volume ratio of the inner blade can not be determined because the thickness of the hardened layer is very thin (=1.5 μm).

The cutting devices obtained in the above examples 1 to 12 and comparative examples 1 to 9 were evaluated in terms of the size of burrs, occurrence of micro-chipping in the cutting edge, wear amount of the cutting edge, cutting resistance, and shaving time. The results are listed on Table 2. The cutting resistance is measured as a load required for cutting a 0.128 diameter acrylic resin filament fixedly extending through the perforation of the outer cutter by moving the inner blades at the speed of 0.5 m/sec. The shaving time is determined as a time required for finishing daily shaving of one-day growth hairs for the same person. In an electric shaver used to measure the shaving time, the inner blades were moved relative to the outer blade at the vibration rate of 9000 times /min. with the vibration stroke of 2.5 mm.

The following is a criterion of judgment as to whether a cutter combination is preferred or not from the results listed on Table 2. That is, when the cutting device meets all of the following conditions [1] to [4] in these evaluations, it can be judged that the cutting device is preferred to provide good shaving performance.

[1] The cutting resistance is less than 120 g.

[2] The shaving time is less than 180 seconds.

[3] The edge wearing is small.

[4] The presence of micro-chipping is none.

In addition, it could be understood that the occurrence of burrs is the cause of increased cutting resistance and extended shaving time.

Thus, since the cutting devices made of the ferrous alloys of the present invention meet all of the conditions [1] to [4], they will be preferably used for an electric shaver to provide good shaving performance.

TABLE 1

| | | Substrate | Hardened layer | | | |
|---|---|---|---|---|---|---|
| | | Hardness (Hv) | Thickness (μm) | Hardness (Hv) | Volume ratio (vol %) | Al content (wt %) |
| Example 1 | outer cutter | 500 | 5 | 1100 | 100 | 52 |
| | inner blade | 500 | 10 | 1100 | 100 | 54 |
| Example 2 | outer cutter | 500 | 5 | 1100 | 100 | 52 |
| | inner blade | 500 | 10 | 1100 | 100 | 54 |
| Example 3 | outer cutter | 500 | 5 | 1100 | 100 | 52 |
| | inner blade | 500 | 10 | 1100 | 100 | 54 |
| Example 4 | outer cutter | 500 | 5 | 1100 | 100 | 52 |
| | inner blade | 500 | 10 | 1100 | 100 | 54 |
| Example 5 | outer cutter | 500 | 5 | 1100 | 100 | 52 |
| | inner blade | 500 | 10 | 1100 | 100 | 54 |
| Example 6 | outer cutter | 500 | 5 | 1100 | 100 | 52 |
| | inner blade | 500 | 15 | 1100 | 100 | 55 |
| Example 7 | outer cutter | 500 | 5 | 1100 | 100 | 52 |
| | inner blade | 500 | 2 | 1100 | 100 | 52 |
| Example 8 | outer cutter | 500 | 5 | 1100 | 100 | 52 |
| | inner blade | 400 | 10 | 1100 | 100 | 55 |
| Example 9 | outer cutter | 500 | 5 | 1100 | 100 | 52 |
| | inner blade | 500 | 10 | 700 | 94 | 39 |
| Example 10 | outer cutter | 500 | 5 | 1100 | 100 | 52 |
| | inner blade | 400 | 3 | 800 | — | — |
| Example 11 | outer cutter | 500 | 5 | 1100 | 100 | 52 |
| | inner blade | 500 | 6 | 900 | — | — |
| Example 12 | outer blade | 500 | 5 | 1100 | 100 | 52 |
| | inner blade | 500 | 5 | 1000 | — | — |
| Comparative | outer cutter | 650 | — | — | — | — |
| Example 1 | inner blade | 600 | — | — | — | — |
| Comparative | outer cutter | 500 | 5 | 1100 | 100 | 52 |
| Example 2 | inner blade | 500 | 10 | 1100 | 100 | 54 |
| Comparative | outer cutter | 500 | 5 | 1100 | 100 | 52 |
| Example 3 | inner blade | 500 | 10 | 1100 | 100 | 54 |
| Comparative | outer cutter | 500 | 5 | 1100 | 100 | 52 |
| Example 4 | inner blade | 500 | 10 | 1100 | 100 | 54 |
| Comparative | outer cutter | 500 | 5 | 1100 | 100 | 52 |
| Example 5 | inner blade | 500 | 10 | 1100 | 100 | 54 |
| Comparative | outer cutter | 500 | 5 | 1100 | 100 | 52 |
| Example 6 | inner blade | 500 | 1.5 | 1100 | — | — |
| Comparative | outer cutter | 500 | 5 | 1100 | 100 | 52 |
| Example 7 | inner blade | 500 | 17 | 1100 | 100 | 55 |
| Comparative | outer cutter | 500 | 5 | 1100 | 100 | 52 |
| Example 8 | inner blade | 350 | 10 | 1100 | 100 | 56 |
| Comparative | outer cutter | 500 | 5 | 1100 | 100 | 52 |
| Example 9 | inner blade | 500 | 10 | 650 | 90 | 35 |

TABLE 2

| | | Cutting edge angle (°) | Burr size (μm) | Presence of micro-chipping | Edge wearing | Cutting resistance (g) | Shaving time (sec) |
|---|---|---|---|---|---|---|---|
| Example 1 | outer cutter | 60 | 1 | no | small | 80 | 130 |
| | inner blade | 60 | 0 | no | small | | |
| Example 2 | outer cutter | 35 | 1 | no | small | 60 | 150 |
| | inner blade | 60 | 0 | no | small | | |
| Example 3 | outer cutter | 90 | 0 | no | small | 100 | 150 |
| | inner blade | 60 | 0 | no | small | | |
| Example 4 | outer cutter | 60 | 1 | no | small | 70 | 130 |
| | inner blade | 50 | 0 | no | small | | |
| Example 5 | outer cutter | 60 | 1 | no | small | 100 | 150 |
| | inner blade | 90 | 0 | no | small | | |
| Example 6 | outer cutter | 60 | 1 | no | small | 80 | 130 |
| | inner blade | 60 | 0 | no | small | | |
| Example 7 | outer cutter | 60 | 1 | no | small | 80 | 130 |
| | inner blade | 60 | 1 | no | small | | |
| Example 8 | outer cutter | 60 | 1 | no | small | 90 | 140 |
| | inner blade | 60 | 0 | no | small | | |
| Example 9 | outer cutter | 60 | 1 | no | small | 90 | 130 |
| | inner blade | 60 | 2 | no | small | | |
| Example 10 | outer cutter | 60 | 1 | no | small | 90 | 140 |
| | inner blade | 60 | 2 | no | small | | |
| Example 11 | outer cutter | 60 | 1 | no | small | 80 | 130 |
| | inner blade | 60 | 1 | no | small | | |
| Example 12 | outer blade | 60 | 1 | no | small | 80 | 130 |
| | inner blade | 60 | 0 | no | small | | |
| Comparative | outer cutter | 60 | 50 | no | small | 160 | 240 |
| Example 1 | inner blade | 60 | 50 | no | small | | |
| Comparative | outer cutter | 60 | 1 | no | small | 50 | 200 |
| Example 2 | inner blade | 30 | 0 | no | small | | |
| Comparative | outer cutter | 60 | 1 | no | small | 150 | 180 |
| Example 3 | inner blade | 100 | 0 | no | small | | |
| Comparative | outer cutter | 30 | 1 | no | small | 50 | 200 |
| Example 4 | inner blade | 60 | 0 | no | small | | |
| Comparative | outer cutter | 100 | 1 | no | small | 170 | 220 |
| Example 5 | inner blade | 60 | 0 | no | small | | |
| Comparative | outer cutter | 60 | 1 | no | small | 140 | 180 |
| Example 6 | inner blade | 60 | 20 | no | small | | |
| Comparative | outer cutter | 60 | 1 | no | small | 80 | 130 |
| Example 7 | inner blade | 60 | 0 | yes | small | | |
| Comparative | outer cutter | 60 | 1 | no | small | 100 | 150 |
| Example 8 | inner blade | 60 | 0 | no | large | | |
| Comparative | outer cutter | 60 | 1 | no | small | 140 | 180 |
| Example 9 | inner blade | 60 | 20 | no | small | | |

What is claimed is:

1. A cutting device for an electric shaver comprising:

an outer cutter and a plurality of inner blades, said outer cutter being made of a ferrous alloy comprising a first substrate of an Fe-Cr stainless steel and a first hardened layer formed on a side face of said first substrate, said plurality of inner blades being made of a ferrous alloy comprising a second substrate of an Fe-Cr stainless steel and a second hardened layer formed on a side face of said second substrate;

said outer cutter formed with a plurality of openings for receiving hairs therethrough, said outer cutter being formed around each of said openings with a first polished contact surface, a first cutting edge, and a side surface of said first hardened layer, said side surface of said first hardened layer being adjacent to said first polished contact surface, an angle of said first cutting edge being defined between said first polished contact surface and said adjacent side surface of said first hardened layer to have an angle of 35° to 90°;

each of said inner blades having a second polished contact surface, a second cutting edge, and a side surface of said second hardened layer, said side surface of said second hardened layer being adjacent to said second polished contact surface, an angle of said second cutting edge being defined between said second polished contact surface and said adjacent surface of said second hardened layer to have an angle of 35° to 90°;

said inner blades being movable relative to said outer cutter in sliding engagement between said respective first and second polished contact surfaces for cutting the hairs by said second cutting edge in cooperation with said first cutting edge;

said first hardened layer being formed on said first substrate so that an end face of said first hardened layer and an end face of the first substrate in cooperation define said first polished contact surface, and so that an edge of said first hardened layer forms said first cutting edge for said outer cutter;

said second hardened layer being formed on said second substrate so that an end face of said second hardened layer and an end face of the second substrate in cooperation define said second polished contact surface, and so that an edge of said second hardened layer forms said second cutting edge for said inner blades; and wherein said first and second substrates have a Vickers hardness of at least 400 and said first and second hardened layers have a Vickers hardness of at least 700, and said first and second hardened layers have a thickness of 2 to 15 μm.

2. The cutting device as set forth in claim 1, wherein at least one of said first and second substrates comprises 73 to 89.9 wt % of Fe, 10 to 19 wt % of Cr, 0.1 to 1.2 wt % of C, and less than 3 wt % Ni.

3. The cutting device as set forth in claim 1, wherein at least one of said first and second substrates comprises 69 to 81.5 wt % of Fe, 12 to 18 wt % of Cr, 6 to 8.5 wt % Ni, 0.5 to 2 wt % of at least one element selected from Al and Ti.

4. The cutting device as set forth in claim 1, wherein at least one of said first and second hardened layers is an Fe-Al diffusion layer comprising at least 90 vol % of intermetallic compounds of Al and Fe relative to a total volume of said diffusion layer; and wherein Al content included within a depth of at least 2 μm of said Fe-Al diffusion layer is 35 to 65% by weight based upon total weight of a region of said Fe-Al diffusion layer ranging up to the thickness of at least said 2 μm.

5. The cutting device as set forth in claim 1, wherein at least one of said first and second substrates is an Fe-Cr-Ni stainless steel, and wherein at least one of said first and second hardened layers comprises particles of a nitride of at least one element selected from the group consisting of Cr, Al, and Ti, which are dispersed in a surface of said first and/or second substrate.

6. The cutting device as set forth in claim 1, wherein at least one of said first and second substrates is an Fe-Cr-C stainless steel, and wherein at least one of said first and second hardened layers comprises particles of chromium nitride dispersed in said first and/or second substrates.

* * * * *